United States Patent [19]

Smith

[11] 4,303,818

[45] Dec. 1, 1981

[54] MICROWAVE OVEN HUMIDITY SENSING ARRANGEMENT

[75] Inventor: Peter H. Smith, Anchorage, Ky.

[73] Assignee: General Electric Company, Louisville, Ky.

[21] Appl. No.: 88,961

[22] Filed: Oct. 29, 1979

[51] Int. Cl.[3] ..... H05B 9/06

[52] U.S. Cl. ..... 219/10.55 B; 219/10.55 R; 324/58.5 C

[58] Field of Search ..... 219/10.55 R, 10.55 B; 73/336, 336.5; 324/58 C, 58.5 C

[56] References Cited

U.S. PATENT DOCUMENTS

| | | | |
|---|---|---|---|
| 2,792,548 | 5/1957 | Hershberger | 324/58.5 C |
| 2,964,703 | 12/1960 | Sargent et al. | 324/58.5 C |
| 3,813,918 | 6/1974 | Moe | 219/10.55 R X |
| 3,839,616 | 10/1974 | Risman | 219/10.55 B |
| 3,946,308 | 3/1976 | Miura et al. | 324/58.5 C |
| 4,042,879 | 8/1977 | Ho et al. | 324/58.5 C |
| 4,080,564 | 3/1978 | Nitta et al. | 219/10.55 B X |
| 4,087,798 | 5/1978 | Thorn et al. | 324/58.5 C X |
| 4,103,224 | 7/1978 | Taro et al. | 73/336.5 X |
| 4,104,585 | 8/1978 | Schofield | 324/58.5 C |
| 4,109,129 | 8/1978 | Satoh et al. | 219/10.55 B |
| 4,115,678 | 9/1978 | Tachikawa et al. | 219/10.55 B |
| 4,132,878 | 1/1979 | Tachikawa et al. | 219/10.55 B |
| 4,133,995 | 1/1979 | Buck | 219/10.55 B X |
| 4,162,381 | 7/1979 | Buck | 219/10.55 B |

FOREIGN PATENT DOCUMENTS

| | | | |
|---|---|---|---|
| 52-51132 | 4/1977 | Japan | 219/10.55 B |
| 54-117960 | 9/1979 | Japan | 219/10.55 B |

*Primary Examiner*—Gene Z. Rubinson
*Assistant Examiner*—Keith E. George
*Attorney, Agent, or Firm*—Bernard J. Lacomis; Radford M. Reams

[57] ABSTRACT

A microwave oven including a resonant cavity humidity sensor operated by microwave energy sampled from the power produced for the cooking operation. The arrangement provides for a flow of moist air from the cooking cavity through an active resonant chamber and a flow of dry air from the atmosphere through a passive resonant chamber. Control circuitry governs the microwave energy flow into the cooking cavity in response to moisture conditions in the cavity so indicated by the sensor.

12 Claims, 4 Drawing Figures

MICROWAVE OVEN HUMIDITY SENSING ARRANGEMENT

BACKGROUND OF THE INVENTION

This invention relates to a new and improved microwave oven heating and control system including a new and improved resonant chamber humidity sensor.

Various kinds of humidity sensors have heretofore been utilized for controlling the operation of microwave ovens. Furthermore, humidity sensors in the form of resonant chambers energized by microwave energy have been disclosed. For example, U.S. Pat. No. 3,946,308 discloses the use of a single resonant chamber for measuring the frequency characteristics of an electric field indicative of the humidity in the chamber. Another approach, disclosed in U.S. Pat. No. 2,964,703, involves the use of dual resonant chambers for humidity measurements. However, resonant chamber humidity sensors have heretofore not been provided as an integral part of a microwave oven heating and control system.

Accordingly, a primary object of the present invention is to provide a new and improved microwave oven including a new and improved humidity sensor for controlling the operation of the oven.

Another object of the present invention is to provide a new and improved resonant chamber humidity sensor.

Another object of the present invention is to provide a new and improved resonant chamber humidity sensor for use in a microwave oven and operated through the use of a portion of the oven-operating microwave energy.

Another object of the present invention is to provide a new and improved resonant chamber humidity sensor for use in a microwave oven and operative in cooperation with the air circulatory system of the oven.

Another object of the present invention is to provide a new and improved microwave oven including a resonant chamber humidity sensor which is implemented through the use of certain components provided for the operation of the oven in general, whereby costly duplication of operating elements and materials is avoided.

Another object of the present invention is to provide a new and improved microwave oven including a dual resonant chamber humidity sensor and an oven humidity controlling and defogging ventilation system which is effectively employed in both conveying the cooking cavity humidity to an active resonant chamber of the humidity sensor and in maintaining a relatively low humidity condition in a passive resonant chamber of the humidity sensor adapted to serve as a reference chamber.

SUMMARY OF THE INVENTION

The present invention, in accordance with one form thereof, comprises a microwave oven incorporating a dual resonant chamber humidity sensor energized by a portion of the microwave energy supplied to the oven for cooking or heating food. Furthermore, the invention utilizes the ventilation system of the oven, which cools the magnetron and defogs the viewing window, for the added purpose of conveying humid air from within the cooking cavity to the humidity sensor. The humidity sensor includes two resonant chambers, one of which constitutes an active chamber and receives humid air from the cooking cavity and the other of which is a passive chamber for receiving relatively dry air from the atmosphere to provide a reference moisture level for comparison against the humidity level in the active chamber. Various elements of control circuity cooperate to compare the two humidity levels and thereby govern the power level in, and the cooking time of, the microwave oven.

BRIEF DESCRIPTION OF THE DRAWING

The invention will be better understood from the following description taken in conjunction with the accompanying drawing, wherein.

DESCRIPTION OF THE PREFERRED EMBODIMENT

Figure 1:
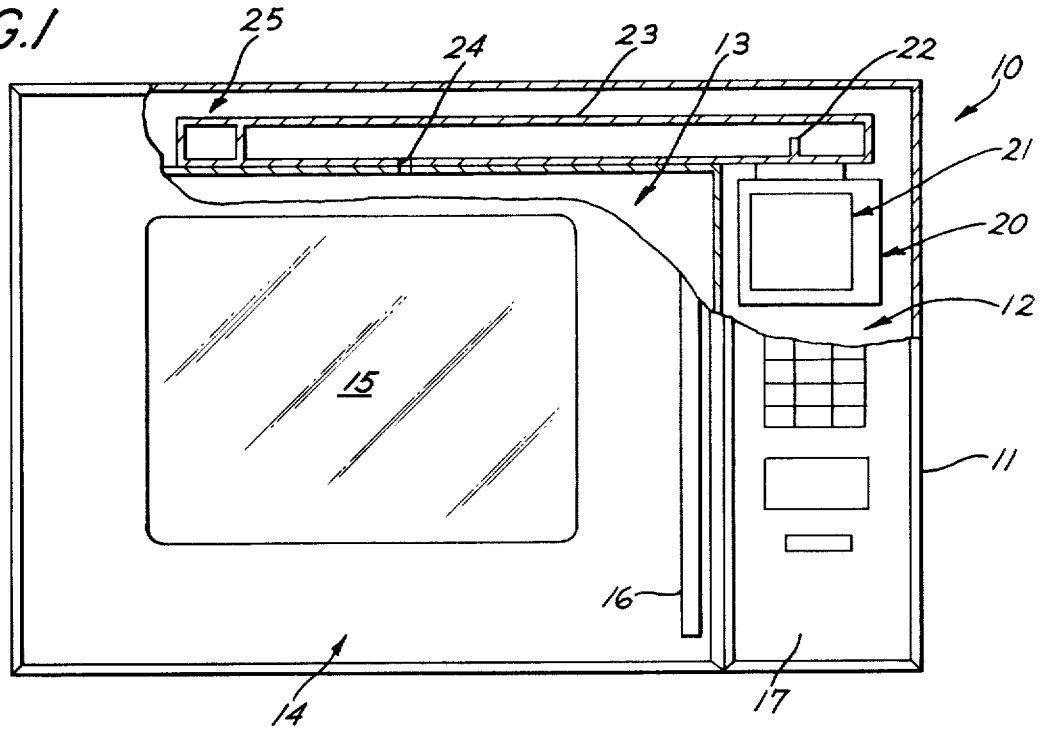
FIG. 1 is a front elevational view of a countertop microwave oven partially broken away to show the interior of the oven and to show a waveguide arrangement for coupling microwave energy into the cooking cavity of the oven and for diverting samples of such energy to resonant chambers constituting parts of a humidity sensor and control arrangement.

Turning now to a consideration of the drawing, and in particular to FIG. 1, there is shown a microwave oven 10 comprising an outer casing 11, an equipment compartment 12, a cooking cavity 13, and a suitably hinged door 14 having a viewing window 15 and a handle 16. Located on the right side of the oven 10 and constituting part of the outer casing 11 is a control panel 17. The compartment 12 is located behind the panel 17 and houses a microwave energy source in the form of a magnetron designated 20, which is cooled by a motor-driven blower or impeller indicated by 21. Additionally, the compartment 12 contains control circuitry illustrated in FIG. 3 and described hereinafter.

The magnetron 20 includes a probe 22 extending into a waveguide 23 mounted on and extending across the top of the cooking cavity 13. The probe 22 feeds microwave energy into the waveguide which includes a slot radiator 24 for electromagnetically coupling the waveguide 23 with the cooking cavity 13. Microwave energy fed into the cavity 13 through the slot radiator 24 is effective for heating the contents of the cavity.

Located at the end of the waveguide 23 opposite the magnetron 20 is a dual resonant chamber humidity sensor generally indicated at 25 which is supported on the top wall of the cooking cavity 13. As better seen in FIG. 2, the humidity sensor 25 comprises three box-like metal compartments which constitute a centrally disposed microwave energy splitter 26 and a straddling pair of resonant chambers 27 and 27'. The compartment constituting the energy splitter 26 extends across the end of the waveguide 23, sharing a common wall therewith. The energy splitter 26 samples a relatively small amount of the microwave energy supplied to the waveguide 23 by the magnetron 20. In one embodiment of this invention, the microwave energy sampling is accomplished by an aperture 30 centrally disposed in the side wall common to the waveguide 23 and the splitter 26. In another embodiment, an aperture 31 shown in phantom in FIG. 2 and centrally located in the floor of the splitter 26, can be used for electromagnetically coupling the cooking cavity 13 and the splitter.

The resonant chambers 27 and 27' are respectively coupled to the splitter 26 by suitable coupling apertures 32 and 32'. This arrangement is effective for feeding substantially equal amounts of microwave energy into the resonant chambers 27 and 27' to establish electric fields therein for energizing the humidity sensor 25. The electric field strength in each of the chambers 27, 27' varies in accordance with the humidity in each chamber. The strengths of the fields in the chambers are measured by electric field detectors 33 and 33', suitably mounted on the side walls of the respective chambers 27 and 27'.

The resonant chamber 27 is an active chamber in that it is in communication with the changeable humidity conditions in the cooking cavity 13 during heating operations. In accordance with the present invention, the humidity level in the active chamber 27 reflects or tracks the humidity condition of the cooking cavity 13. In response to the reflected humidity condition, the detector 33 in the active chamber 27 produces a corresponding field strength signal.

The resonant chamber 27' is a passive chamber, and is in communication with the external atmosphere without being exposed to the humidity changes occurring within the cavity 13. Accordingly, the humidity level within the passive chamber 27' is substantially the same as the humidity in the external atmosphere. Therefore, the electric field sensed within the passive chamber 27' by the electric field detector 33' reflects the external atmospheric humidity level. A corresponding field strength signal produced by the detector 33' thus reflects the internal humidity of the passive chamber and provides a standard for comparison with the field strength signal of the active chamber 27.

In order to facilitate the performance of the humidity sensor 25, the two resonant chambers 27 and 27' are electromagnetically balanced by a chamber tuning screw 34 having a conductive tip 34' thereon extending inside the passive chamber 27'. However, the screw 34 could just as effectively be positioned inside the active chamber 27. Additionally, each chamber 27 and 27' is constructed to exhibit a maximum electrical quality factor (Q) at minimum humidity in terms of water vapor. The walls of the resonant chambers 27 and 27' are formed of aluminized steel, which maximizes the conductivity of the inner skin of the chambers 27 and 27' and helps to establish a high Q value.

Figure 3:
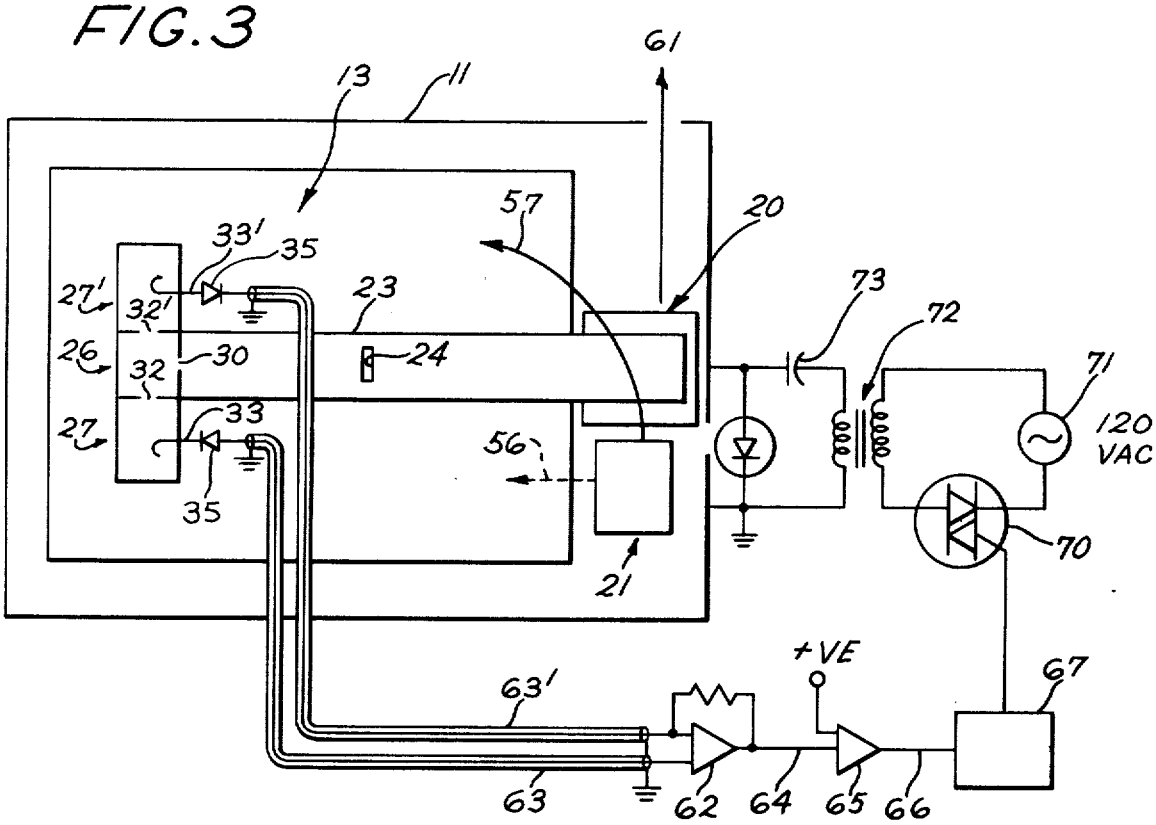
FIG. 3 is a schematic illustration of the oven and the various components thereof including electrical control circuitry for coupling microwave energy to the oven cavity, to an energy splitter, and from the energy splitter to the resonant chambers of the humidity sensor.
Figure 4:
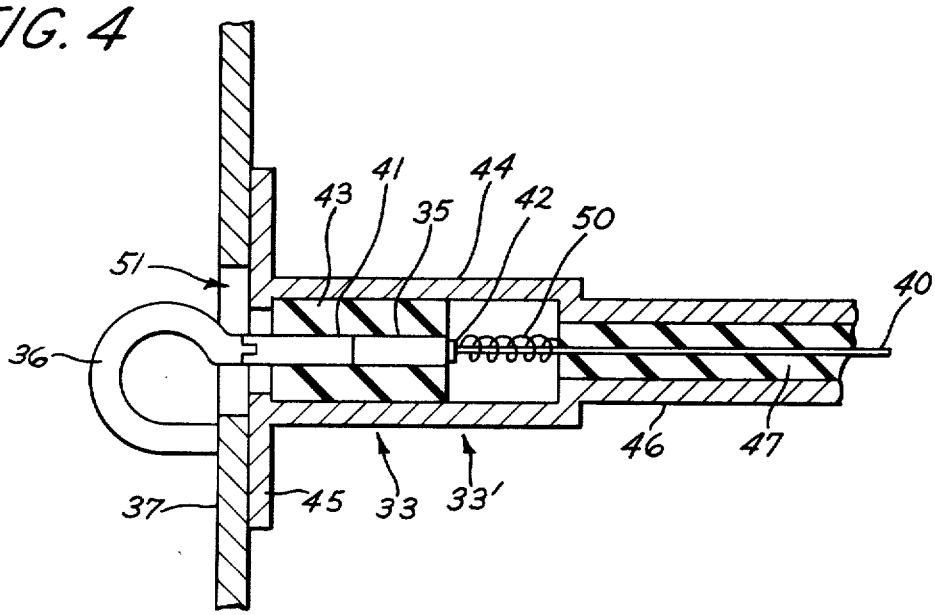
FIG. 4 is an enlarged sectional view of one of a pair of detectors mounted on the resonant chambers of the humidity sensor for measuring electrical field strengths in the chambers.

The electric fields within the chambers 27 and 27' are individually sensed by the detectors 33 and 33', respectively, at substantially similar locations in the chambers. However, for a reason brought out in detail hereinafter, a crystal 35 in one of the detectors and shown in FIG. 4 is reversed to produce a signal of opposite polarity by that detector, relative to a signal produced by the other detector. FIG. 4 illustrates each of detectors 33 and 33' as they are similar in all significant features, except for the resistive orientation of the crystal 35, which is not apparent from the drawing in FIG. 4, but is shown schematically in FIG. 3.

Each detector 33, 33' comprises an inductive loop 36 which clamps onto the interior of a chamber wall 37 into which it is plugged through a suitable aperture. The loop 36 is connected to an inner coaxial conductor 40 through an inner connector 41, the field sensitive crystal 35, and an interior conductor contact 42. The crystal 35 and part of the inner connector 41 are enclosed by a dielectric sleeve 43 within an outer shell 44 which is electrically connected to a detector base 45 and a coaxial lead 46 of a suitably shielded cable. The inner coaxial conductor 40 and the coaxial lead 46 are insulatively separated by a dielectric sleeve 47. The attachment of the detector loop 36 to the chamber wall 37 is accomplished by pulling the loop 36, the inner connector 41, and the crystal 35 axially away from the biasing direction of a helical spring 50 fastened to the crystal 35 at one end and suitably anchored at its opposite end, and maneuvering the loop through a hole 51 in the chamber wall 37 before releasing the loop 36. When the loop 36 is released, the spring 50 biases it into effective electrical and mechanical contact with the chamber wall 37.

Figure 2:
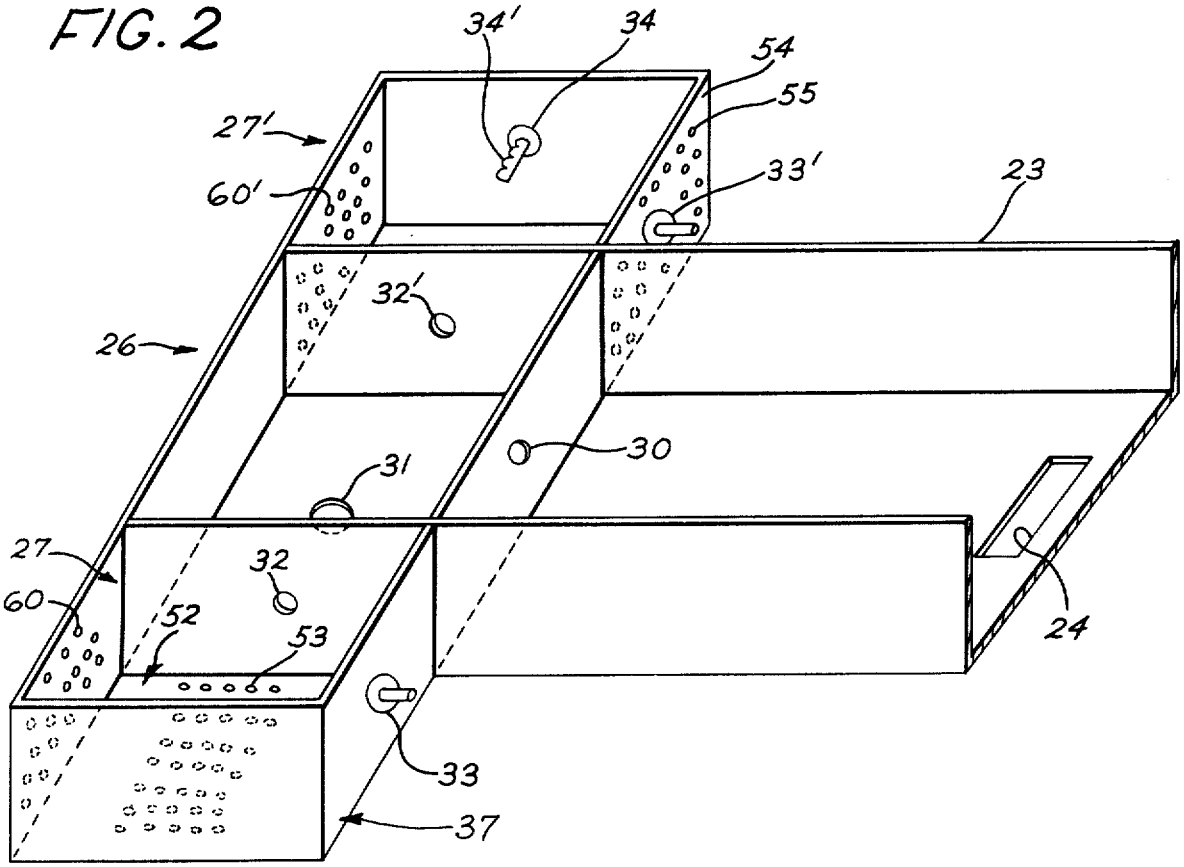
FIG. 2 is a fragmentary perspective view of an arrangement for delivering microwave energy to the oven cavity and for sensing humidity conditions in the cavity, having the top walls of its several compartments removed to facilitate understanding.

Turning again to FIG. 2, the communication between the active chamber 27 and the cooking cavity 13 is best accomplished by perforating a wall section 52 which is common to the cooking cavity 13 and the active chamber 27 with a multiplicity of apertures 53. Additionally, the portion 54 of wall 37 of the passive chamber 27', not oriented toward or common with the cavity 13, is also perforated by a multiplicity of apertures 55 to provide communication between passive chamber 27' and the external atmosphere. The multiplicities of apertures 53 and 55 in the walls of the respective chambers 27 and 27' allow air flow into the active chamber 27 from the cavity 13 and into the passive chamber 27' from the atmosphere surrounding the cavity 13. Similar multiplicities of apertures 60 and 60' in other walls of the active and passive chambers 27 and 27' allow ready removal of air from the chambers 27 and 27', whereby the responsiveness of the humidity sensor 25 to changes in the cavity moisture level is substantially enhanced. Furthermore, the rates of air flow through the chambers 27, 27' are made even greater by means effective for forcing suitably moist or dry air from the cavity 13 or the atmosphere through the chambers 27, 27' with external pressure from the motor-driven blower 21 shown in FIG. 1. Blowers of this type are generally provided to cool the magnetron 20 and to keep the viewing window 15 free of moisture, but in the present invention it additionally serves to enhance the operation of the humidity sensor 25 by suitably accelerating the movement of air through the respective chambers 27 and 27'. A system of suitable ducts and apertures directs the air propelled by the blower 21 along separate paths to the active and passive chambers 27 and 27' as shown in FIG. 3. One path leading to the active chamber 27 is generally indicated in FIG. 3 by an arrow 56. Air from the atmosphere is propelled along this path from the blower into the cooking cavity 13 through a suitable aperture (not shown) to pressurize the cavity 13. The common-wall apertures 53 seen in FIG. 2 and extending between the cavity 13 and the active chamber 27 offer an avenue of escape of air from the cooking cavity 13. Accordingly, a current of air flows rapidly from the cavity 13 into the active chamber 27, conveying moisture from the cavity 13 into the active chamber. Another path generally indicated by an arrow 57 leads from the blower 21 to the passive chamber 27'. Air flowing in this path is propelled from the blower 21 between the oven casing 11 and the cavity 13 to the passive chamber 27. The multiplicity of apertures 55 in the passive chamber 27' for allowing communication with the atmosphere are located in the walls of the chamber 27' which extend across the path of the air flow from the motor blower 21. As shown in FIG. 2, the wall 54 containing the multiplicity of apertures 55 faces toward the equipment chamber 12 seen in FIG. 1, containing the blower 21.

FIG. 2 also shows the exit apertures 60 and 60' from the active and passive chambers 27 and 27' facing away from the motor blower 21 to facilitate the departure of air from the resonant chambers 27 and 27'. A suitably situated opening (not shown) in the casing 11 allows the departure of this air into the external atmosphere. Insofar as the possible communication of air from the active chamber 27 into the passive chamber 27' through the splitter coupling apertures 32 and 32' is concerned, the amount of moisture that may be involved is negligible and would not detrimentally affect the operation of the humidity sensor 25.

To perform the cooking operation, food is placed within the cooking cavity 13 and a suitable control switch (not shown) energizes the magnetron 20 to begin feeding microwave energy into the waveguide 23 and into the cooking cavity 13 through the slot radiator 24. Simultaneously, the blower 21 cools the magnetron 20, directs dry air from the atmosphere through the passive chamber 27', and directs other air from the atmosphere first through the cooking cavity 13 and then through the active chamber 27. If there is a higher moisture content in the air of the active chamber 27 than in that of the passive chamber 27', the humidity sensor 25 provides the control circuitry with suitable electric signals for controllably altering the magnetron output.

More particularly, the blower 21 cools the magnetron 20 by propelling air from the atmosphere past it, which is then returned to the atmosphere as indicated by path 61. The blower 21 also drives the air into the cooking cavity 13 along path 56. Furthermore, the blower propels air along path 57 through the passive chamber 27'. During the initial stages of cooking and before any steam is produced, the dry air from the blower 21 absorbs a certain amount of moisture in the cooking cavity 13 and in the active chamber 27 remaining from prior cooking cycles. The blower 21 also maintains the viewing window 15 free and clear of moisture.

When the humidity sensor 25 is energized and the chambers 27, 27' are at or near resonance, an electric field is established in each of the chambers 27, 27' for measurement by the field detectors 33, 33'. The field levels depend on the concentrations of moist air within the chambers 27, 27', inasmuch as moisture absorbs a considerable amount of electromagnetic energy within the chambers 27, 27'. The field in each chamber 27, 27' produces a direct current in the loop 36 of the respective field detector 33, 33' proportional to and representative of the concentration of moisture in the chamber, and both detectors 33 and 33' are electrically connected to an operational amplifier 62 through suitable electric conductors, respectively designated 63 and 63'. Each detector 33, 33' provides the operational amplifier 62 with its own direct current signal representative of the electric field within its respective resonant chamber 27, 27'. If the humidity is the same in both chambers 27 and 27', the operational amplifier 62 receives two equal but opposite signals which cancel each other, inasmuch as the detectors 33 and 33' are of opposite polarity, as indicated above. When the humidity in the active chamber 27 is not the same as that of the internal atmosphere, the operational amplifier 62 produces a signal representative of the difference between the electric signals from the two detectors 33 and 33'. The operational amplifier 62 then communicates the signal representative of the difference through a suitable electrical conductor 64 to a comparator 65 which measures the signal against a predetermined threshold value, +VE. The comparator 65 provides an output signal herein referred to as an excess threshold signal, which is proportional to the excess of the signal the comparator 65 receives from the operational amplifier 62 over the threshold value, +VE. The excess threshold signal is transmitted by means of a suitable electrical conductor 66 to a suitable microprocessor generally designated 67 which sends appropriate gating signals to a triac 70. In a manner well known in the art, the gating signals control the current flowing to the magnetron from a standard 120 volt power source 71. More specifically, the triac 70 allows the standard voltage source 71 to supply power to the magnetron 20 in accordance with the gating signals from the microprocessor 67 through a plate transformer 72 and a halfwave doubler circuit including a capacitor 73 and a diode 74. Thus, the magnetron 20 is controlled in its function of providing microwave energy to the cooking cavity 13, in a manner which enables the oven to function responsively to humidity conditions in the cooking cavity.

Reference to the microprocessor 67 is made in this disclosure to illustrate an operative embodiment of the invention, but the microprocessor 67 is not essential to this invention and other suitable circuitry elements can be substituted to provide the requisite triac gating signals in response to the output signal from the comparator 65.

After reference to the foregoing, modifications of this invention may occur to those skilled in the art. However, it is to be understood that this invention is not intended to be limited to the particular embodiment shown and described herein, but is intended to cover all modifications coming within the spirit and scope of the invention as claimed.

What is claimed is:

1. In a microwave oven, a microwave heating cavity;

a source of microwave energy;

a waveguide for coupling said source of microwave energy to said cavity;

a pair of resonant microwave chambers, including an active chamber and a passive chamber;

a splitter electromagnetically coupled to each of said waveguide and said active and passive chambers for sampling a portion of microwave energy from said source and coupling a substantially equal amount of the sample to each of said chambers;

means for establishing direct communication between said cavity and said active chamber whereby humidity conditions in said cavity are represented in said active chamber and influence the strength of the electric field in said active chamber;

means for sensing the field strength in each of said chambers and providing individual field strength signals corresponding thereto; and means for comparing the field strength signals from both said chambers and providing a comparator output signal indicative of the humidity condition in said cavity.

2. The invention of claim 1, further comprising control means for controlling said source of microwave energy with said comparator output signal as said signal varies in accordance with the humidity condition in said cavity.

3. The invention of claim 2, wherein said control means comprises means for receiving said field strength signals, summing them, comparing the results to a predetermined threshold value, and providing an excess threshold signal.

4. The invention of claim 3, wherein said control means further comprises means controlled by said excess threshold signal and effective for determining the operation of said energy source.

5. The invention of claim 1, wherein said splitter is electromagnetically coupled to said cooking cavity.

6. The invention of claim 1, wherein the coupling between said splitter and each said active and passive chambers is effected by a coupling aperture.

7. The invention of claim 1, wherein said waveguide, said active and passive chambers, and said power splitter are mounted on a wall of said cavity;

said waveguide is electromagnetically coupled to said cavity; and said active and passive chambers are disposed on opposite sides of said splitter.

8. The invention of claim 1, wherein each of said means for sensing the field strength in each said chambers comprises an electric field detector extending into a respective chamber.

9. The invention of claim 1, wherein each of said chambers is vented to the atmosphere.

10. The invention of claim 9, wherein said cavity and said active chamber have a commmon wall section perforated to permit moisture in said cavity to enter said active chamber;

another wall section of said active chamber is perforated to vent said active chamber to the atmosphere; and a pair of opposite wall sections of said passive chamber are perforated to enable circulation of air through said passive chamber.

11. The invention of claim 10, further comprising means for directing a flow of air in a plurality of paths, one of said paths extending through and ventilating said cavity and said active chamber and another of said paths extending through and ventilating said passive chamber.

12. The invention of claim 11, wherein said means for directing a flow of air in a plurality of paths is supplied with air from means provided for air cooling said microwave energy source.

* * * * *